United States Patent [19]

Swanson

[11] Patent Number: 4,799,851

[45] Date of Patent: Jan. 24, 1989

[54] LEVEL LIFT HYDRAULIC VALVE

[76] Inventor: William C. Swanson, 132 Ann St., Clarendon Hills, Ill. 60514

[21] Appl. No.: 149,377

[22] Filed: Jan. 28, 1988

[51] Int. Cl.[4] ..... B66F 9/00

[52] U.S. Cl. ..... 414/700; 91/520; 91/532; 91/535

[58] Field of Search ..... 414/708, 700; 91/514, 91/516, 518, 520, 526, 528, 530, 531, 533, 535

[56] References Cited

U.S. PATENT DOCUMENTS 3,811,587 5/1974 Seaberg ..... 414/708 X 4,709,618 12/1987 Zongker ..... 414/708 X 4,723,478 2/1988 Diel et al. ..... 414/708 X

*Primary Examiner*—Robert J. Spar

*Assistant Examiner*—Donald W. Underwood

[57] ABSTRACT

Level lifting and lowering of a working implement in combination with a hydraulic boom is provided through a hydraulic circuit and valve including a shuttle check valve, a rotary flow divider and a counterbalance valve. Selective operation results in the working implement being raised or lowered in a level displacement relative to the ground.

3 Claims, 1 Drawing Sheet

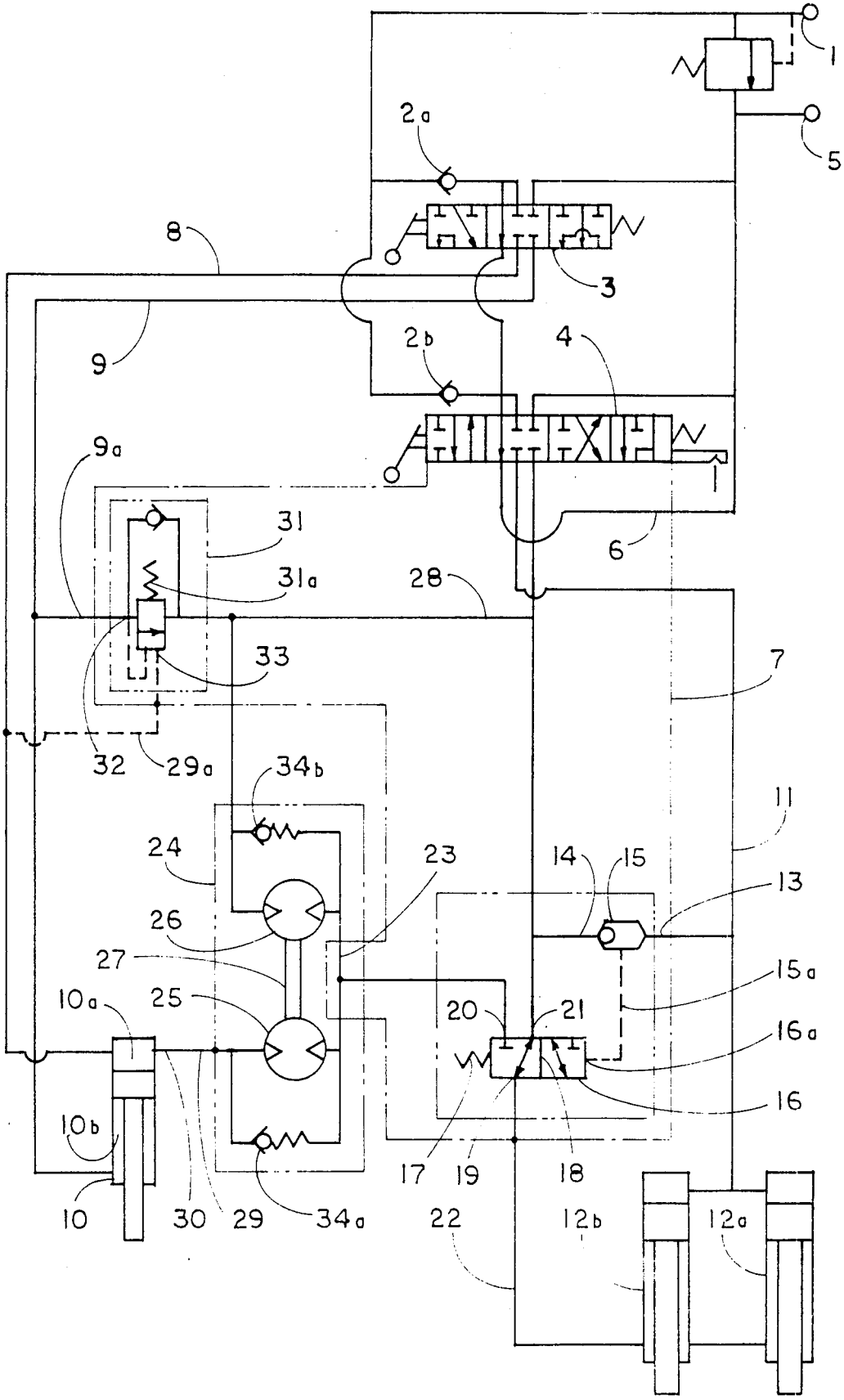
1
5
2a
3
8
9
2b
4
9a
31
31a
28
6
33
7
32
29a
34b
11
24
23
14
15
13
26
27
15a
10a
25
20
21
16a
16
10b
17
19
18
10
30
29
34a
22
12b
12a

LEVEL LIFT HYDRAULIC VALVE

This invention concerns a hydraulic circuit and apparatus that allows the bucket of a loader type vehicle to be raised or lowered while the bucket remains level. The advantage of such a level lifting circuit and apparatus is that the level lift function releases the loader operator from the task of maintaining the bucket in a level position while the main boom of the host vehicle is being raised or lowered thus preventing spillage of material from the bucket.

Loader type vehicles comprise a broad range of load handling apparatus that include pallet lifting loaders, construction loaders, loading vehicles used in industrial environments and farm implement loaders. The load containing element of such loader type vehicles is often a bucket or shovel used to pick up, elevate and subsequently dump a load.

Although the hydraulic valve circuit, incorporated ito a unified housing in the inventor's best mode, can be used in many applications it finds its greatest utility in so called front end loaders.

A front end loader typically incorporates a pivoting transverse bucket supported by an arm at each end of the bucket. These bucket support arms or boom arms are pivotally mounted at one end to the frame of the host vehicle and at the other end to the transverse bucket.

A pair of hydraulic bucket actuating cylinders or rams are pivotally mounted to the bottom arms at one end of the cylinder and pivotally mounted to the bucket at at the other end of the cylinders. The load carrying bucket is thus pivotally mounted so that upon extension of the bucket actuating cylinders the bucket can be pivoted forward to dump its contents or "rolled back" to maintain the bucket contents in the bucket as the bucket is lifted by the boom arms which may typically be raised or lowered by a second set of hydraulic cylinders referred to herein as boom actuating cylinders.

The general arrangement and mounting of a bucket on a front end loader of the type described above is well known.

One of the operating difficulties with such state of the art front end loaders is the lack of a level lift control system that will keep the bucket in a rolled back attitude as the bucket is raised or lowered through the travel of the boom arms. Such control of the level attitude of the bucket is accomplished by the skillful manipulation by the loader operator of the bucket level valve and the main lift valve control. This requires dexterity, hand coordination, attention and skill on the part of the operator.

The invention presented herein, of course, requires operator skills that are honed through experience but does provide a level lift hydraulic control circuit and apparatus that can assist such a skilled operator in working faster and more efficiently as the apparatus and control circuit provided herein will automatically compensate and control the relationship between bucket attitude and the position of the boom arms. This is done by metering flow to or from the bucket actuating cylinders in response to the movement of the boom actuating cylinders.

The advantages of the invention will be apparent from an understanding of the drawing FIGURE when examined in light of the teaching of this specification.

The sole FIGURE shows that part of the hydraulic circuit of a front end loader that controls the lifting of the load carrying bucket and attendant level lift circuit and apparatus.

Equipment on the machine includes a hydraulic pump, not shown, drawing fluid from a reservoir, also not shown but of conventional construction, and delivering it through supply conduits to the end cover inlet port 1 of the level lift valve shown in the drawing. The hydraulic fluid is directed through first and second load holding check valves 2*a* and 2*b* respectively of the manually controlled three position four-way 3 and four position four-way 4 valves respectively. Open center valves are shown for simplicity although a closed center system with pressure and/or pressure and flow compensated pumps would be equally appropriate. In a mode where the bucket is not being raised or lowered the hydraulic fluid is directed back to the outlet port 5 through internal passage 6 of the abutting manifold 7 of the level lift valve. The manifold is schematically represented by the area enclosed in the broken line to which the reference character 7 lead line is attached. The broken line enclosed a counterbalance valve 31 and a directional flow control valve 16. The manifold represented by the area enclosed by the broken line 7 does not include the rotary flow divider 24 which is, however, bolted to the manifold 7, or the four position four-way valve 4 which is likewise bolted to the manifold 7. The manifold is provided with numerous internal passages connecting the various ports of the attached equipment.

If the working attitude of the load carrying bucket is not in the desired position, three position four-way valve 3 is operated to divert hydraulic fluid either through conduits 8 or 9 to the bucket actuating cylinder 10. In the embodiment shown only one bucket actuating cylinder is illustrated for simplicity, however it is usual for a front end loader to be equipped with a pair of bucket actuating cylinders and such a construction is contemplated by the inventor. After the machine operator has filled the bucket and returned the bucket to a lifting position, three position four-way valve 3 is returned to the neutral or blocked position as shown in the Figure.

Four position four-way valve 4 is then activated by the operator, directing fluid through conduit 11 to the piston end or lifting ends of the bottom cylinders 12*a* and 12*b*.

The induced flow into the piston end chambers of the boom actuating cylinders 12*a* and 12*b* generates a pressure rise against the bottom load. This pressure is conveyed to shuttle check valve 15 through manifold passage 13. The pressure signal is transmitted through shuttle check valve 15 via pilot line 15a to the pilot port 16a of directional flow control valve 16. As the pressure rises from the resisting boom actuating cylinder load to a value high enough to overcome biasing spring 17 of the directional flow control valve 16, spool 18 is moved to connect port 19 to port 20 thereby closing off the previously open port 21.

This position allows flow of hydraulic fluid from the rod side of bottom actuating cylinders 12*a* and 12*b* through conduit 22 to manifold 23 which directs the fluid to the inlet of rotary flow divider 24.

The rotary flow divider 24 is made up of two independent positive displacement fluid transferring units 25 and 26, coupled together by a common shaft or coupling 27.

The coupling of the two positive displacement fluid transferring units can be a solid connections as shown or could alternatively be a pair of externally splined axles each inserted into an internally splined tube such that the fluid transferring units can move laterally independent of each other.

The displacement of fluid transferring units 25 and 26 can be equal or unequal, one greater or lesser than the other.

The primary fluid transferring unit 25 transfers some of the boom actuating cylinder 12*a* and 12*b* rod side flow to the piston side 10*a* of the bucket actuating cylinder 10 through passage 29 to conduit 30 and subsequently to conduit 8. The remainder of boom actuating cylinder rod side flow, admitted to conduit 22, is transferred through secondary fluid transferring unit 26 into internal passage 28 and back to tank through the manually operated four position four-way valve 4.

The proportionate amount of hydraulic flow that is transferred by primary fluid transferring unit 25 from the rod side of the bottom actuating cylinders 12*a* and 12*b* to the piston side 10a of bucket actuating cylinder 10 is based on the ratio of the displacement of bucket actuating cylinder 10 required to keep the bucket level and to the rod side displacement of the boom actuating cylinders during the total lift cycle.

To better control any overcenter laods transferred to bucket actuating cylinder 10 from the load carrying bucket, counterbalance valve 31 is used. As stated earlier, the counterbalance valve can be incorporated into the manifold or it can be, alternatively, external of the manifold. The rod side 10b flow from the bucket actuating cylinder 10 is transferred through conduits 9 and 9*a* to port 32 of the counterbalance valve 31. Pilot pressure communicated through the pilot passage 29*a* to port 33 meters open counterbalance valve 31 when the pressure in pilot line 29*a* is sufficient to overcome the spring 31*a* in the counterbalance valve 31. This will happen when the pressure in the head end 10*a* of the bucket actuating cylinder 10 increases due to an increased load in the rod side chamber 10*b* of the bucket actuating cylinder. This allows bucket cylinder rod side 10*b* flow to return to internal passage 28, joining exess flow from secondary transfer unit 26 to return to tank through manually operated four position four-way valve 4.

After the boom arms have been raised to the desired unloading height the manually operated four position four-way valve 4 is returned to the neutral or blocked position as shown in the Figure. Manually operated three position four-way valve 3 is then positioned to extend cylinder 10 to unload or dump the bucket. After dumping the load the three position four-way valve 3 is positioned to retract bucket actuating cylinder 10 to a desired lowering position and returning the three position four-way valve 3 to the neutral or blocked position.

By engaging manually operated four position four-way valve 4 into the bottom actuating cylinder lowering position hydraulic flow is admitted to internal passage 28, internal passage 14 and into port 21 and out of port 19 through conduit 22 and into the rod side of boom actuating cylinders 12*a* and 12*b*. Whatever the lowering load pressure in the piston side of the boom actuating cylinders is during this phase, the rod side pressure will be amplified by the ratios of those two sides. Generally the amplification is about 2 to 1. Therefore, the lowering rod pressure will be admitted to internal passage 14 through shuttle check valve 15 to the pilot port 16a of directional flow control valve 16. The amplified lowering pressure will be sufficient to move spool 18, overcome biasing spring 17, to connect port 20 to port 19 and close previously open port 21. With port 21 blocked, hydraulic flow will continue through internal passage 28, through the free flow direction of the check valve position of counterbalance valve 31 and out port 32 to conduit 9.

Also, flow is admitted to the previous outlet side of secondary positive displacement fluid transfer unit 26, which now becomes one of the inlets to the rotary flow divider 24. With retraction of bucket actuating cylinder 10 the piston side flow enters conduits 8 and 30, passage 29 and pilot passage 29*a*. This flow is now directed into the previous outlet side of the primary positive displacement fluid transferring unit 25 which now becomes the other inlet to the rotary flow divider 24.

The flow now turns the rotary flow divider in the opposite direction from the lifting phase and it now becomes a flow combining unit.

The proportionate amount of flow from the piston side of the bucket actuating cylinder 10 to keep the bucket level in lowering is also controlled by the displacement ratio of the primary positive displacement fluid transferring unit 25 to the secondary positive displacement fluid transferring unit 26, just as in lifting.

With the two flows combined in communicating passage 23, the flow is then conveyed to port 20 and out port 19 of the directional flow control valve 16.

The combined flow returns through conduit 22 and into the rod side of the boom actuating cylinders 12*a* and 12*b* causing the boom actuating cylinders to retract and lower the bucket carrying boom arms. The piston side flow of the boom actuating cylinders returns through fluid conduit 11 to the four position four-way valve 4 and back to tank through outlet port 5.

The relief valve 34*a* across ports of primary positive displacement fluid transfer unit 25 the rotary flow divider 24 is used to rephase the relative position of the bucket actuating cylinder 10 to the boom actuating cylinders 12*a* and 12*b*. If excessive internal leakage across the piston seals of the boom actuating cylinders occurs, this will cause the bucket actuating cylinder 10 to fully extend before the boom actuating cylinders are fully extended.

The flow from the boom actuating cylinders rod sides will flow across the rotary flow divider around and through relief valve 34*a* back to manifold 23, join the flow into secondary positive displacement fluid transferring unit 26 and out to conduit 28. This transfer of hydraulic fluid will allow the boom actuating cylinders to fully extend.

During the rephasing cycle secondary positive displacement fluid transferring unit 26 becomes a motor adding torque to the primary positive displacement fluid transferring unit 25, which becomes a pump that delivers excess fluid across relief valve 34*a*. The pressure in pilot passage 29*a* will intensify by the differential setting of relief valve 34*a*. This setting is kept relatively low and is in the range of just above the pressure drop generated across the primary positive displacement fluid transfer unit 25 by the maximum flow rate in that part of the system.

The relief valve 34*b* is provided so that when the bucket actuating cylinder 10 is fully retracted and the four position four-way valve 4 is in the lowering position and the operator wishes to keep the bucket fully rolled back the bucket will remain rolled back. Since no fluid flow will be available from the piston side chamber of the bucket actuating cylinder 10 the rotary flow divider 24 will be bypassed by fluid being directed to the boom actuating cylinders 12*a* and 12*b* through internal passages 28, 23, and 22.

There are times of operation of the front end loader when the bucket is locked in place, but the boom arms have to have freedom of vertical movement, called "float". This mode is used for back grading or filling the bucket from stockpiles of semi-loose materials to be transferred elsewhere.

This float condition is accomplished by placing the four position four-way valve 4 into the float or fourth position. This position internally connects in parallel supply line fluid conduit 11 and internal passage 28 to tank. This reduces either of the supply lines to a pressure lower than the force exerted by biasing spring 17 which in turn returns spool 18 to a position to connect ports 21 and 19. This allows unrestricted flow from the rod side to the piston side of boom actuating cylinders 12a and 12b, thus providing free vertical movement of the boom. Spool 18 also closes off port 20 locking bucket actuating cylinder 10 in a position to hold the bucket in a pre-set attitude but still allowing the bucket to float.

Thus it can be seen that there has been provided a hydraulic circuit for use with a bucket on a front end loader that will maintain a preset level attitude as the bucket is being raised or lowered. The invention may be used in other related hydraulic applications where a relative attitude between two separately controlled hydraulic elements is desirable such as, for instance, the control of the forks or tines of a rough terrain fork lift vehicle. In such fork lift application of the float feature may not be necesary. In such a case the shuttle check valve 15 and the directional flow control valve 16 would be replaced with a standard cavity plug and a modified cavity plug modified to allow port 19 to communicate with port 20. Such nuances of design that would naturally flow from the teaching of this specification are contemplated by the inventor and are covered by the following claims.

What is claimed is:

1. A hydraulic circuit apparatus, including conduit means and a source of hydraulic fluid, for providing level lift and lowering of an impliment pivotally supported on boom arms which in turn are pivotally supported on a supporting frame, the hydraulic circuit comprising:

a pair of boom actuating cylinders each pivotally attached at one end to said supporting frame and each pivotally attached at second ends to respective boom arms;

a pair of bucket actuating cylinders pivotally attached at one end to said boom arms and pivotally attached at their other ends to said implement respectively;

a four position four-way valve connected to said source of hydraulic fluid and said boom actuating cylinders;

a three position four-way valve connected to said source of hydraulic fluid, said bucket actuating cylinders and said four position four-way valve;

a directional flow control valve having a two position spool valve biased by a biasing spring to a first position and a shuttle check valve normally allowing the passage of hydraulic fluid when said spool valve is in said first position and preventing the passage of hydraulic fluid when said spool valve is in a second position;

a counterbalance valve connected by conduit means to said four position four-way valve and said pair of bucket actuating cylinders;

a rotary flow divider having primary and secondary positive displacement fluid transferring units connected together, said rotary flow divider having a port for communicating with said directional flow control valve, a pair of ports communicating through conduit means with said bucket actuating cylinders, said four position four-way valve and said counterbalance valve;

whereby said bucket actuating cylinders will receive a metered flow of hydraulic fluid from said rotary flow divider when said boom actuating cylinders are being raised and said three position four-way valve is open allowing hydraulic fluid flow through said conduit means for said source of hydraulic fluid and said bucket actuating cylinders will deliver a metered flow of hydraulic fluid to said rotary flow divider when said boom actuating cylinders are being lowered and said three position four-way valve is open allowing hydraulic fluid to flow through said conduit means to tank.

2. The invention in accordance with claim 1 wherein said rotary flow divider includes a first relief valve.

3. The invention in accordance with claim 2 wherein said rotary flow divider includes a second relief valve.

* * * * *